United States Patent [19]

Curtillat

[11] 4,051,580

[45] Oct. 4, 1977

[54] METHOD AND APPARATUS FOR STUFFING YARNS

[75] Inventor: Pierre Curtillat, Lyon, France

[73] Assignee: Rhone-Poulenc-Textile, Lyon Cedex, France

[21] Appl. No.: 645,389

[22] Filed: Dec. 30, 1975

[30] Foreign Application Priority Data

Dec. 31, 1974 France ..... 74.43588

[51] Int. Cl.[2] ..... D02G 1/20; D02G 1/16; D02C 1/12

[52] U.S. Cl. ..... 28/255

[58] Field of Search ..... 28/1.3, 1.4, 1.6, 72.11, 28/72.12, 72.14, 255

[56] References Cited

U.S. PATENT DOCUMENTS

| | | | |
|---|---|---|---|
| 2,914,835 | 12/1959 | Slayter et al. | 28/1.3 X |
| 3,160,923 | 12/1964 | Rainard et al. | 28/1.6 |
| 3,343,240 | 9/1967 | Parmeggiani et al. | 28/1.6 X |
| 3,389,445 | 6/1968 | Schreffler | 28/1.3 |
| 3,438,101 | 4/1969 | Le Noir et al. | 28/1.6 |
| 3,763,525 | 10/1973 | MacKnight | 28/1.3 |
| 3,778,872 | 12/1973 | Newton | 28/1.6 |
| 3,840,950 | 10/1974 | Stanley | 28/1.3 |
| 3,879,821 | 4/1975 | Stanley | 28/1.4 X |
| 3,896,529 | 7/1975 | Stanley | 28/1.6 |

*Primary Examiner*—Louis K. Rimrodt
*Attorney, Agent, or Firm*—Sherman & Shalloway

[57] ABSTRACT

A yarn-stuffing system is disclosed in which the yarn is drawn in and expanded by a pneumatic nozzle and the yarn and air are conducted longitudinally to a discharge zone remote from the nozzle. The air is vented laterally in the discharge zone while the yarn is inhibited in its discharge to be stuffed and is periodically released to emerge stepwise from the discharge zone. The preferred apparatus includes a constricted yarn-stuffing and discharge zone which is expandable to allow slip of the stuffed yarn until pressure is relieved behind the stuffed yarn and returns to its constricted position until the pressure again rises as a result of obstruction of the vent ports.

8 Claims, 5 Drawing Figures

METHOD AND APPARATUS FOR STUFFING YARNS

BACKGROUND OF THE INVENTION

The present invention relates to the stuffing of yarns and is concerned more particularly with the stuffing of continuous multi-filament yarns at very high speeds to form and discharge a closely-packed stuffing of the opened yarn.

BRIEF DESCRIPTION OF THE PRIOR ART

A variety of attempts have been made to treat yarns by expansion texturizing and stuffing, such as the pneumatic expanders and stuffers disclosed in the several French Pat. Nos. 1289491, 2052161 and 2110561, and the pneumatic stuffer disclosed in French Pat. No. 1558266.

Typically, pneumatic expanders and stuffers receive a continuous yarn of multiple filaments via a pneumatic injector which drives the yarn longitudinally, while the expansion and turbulence of the air or fluid loosens and separates the filaments of the yarn. The yarn and fluid are thus introduced into a tubular chamber which has lateral vents at an intermediate point along its length. Upon lateral venting of the fluid, the yarn is suddenly decelerated and accumulates as a random stuffing in a downstream portion of the tube. The residual fluid pressure intermediate the nozzle and the vents is relied upon to discharge the stuffing against the drag resistance along the surface of the tube. In certain cases, the expansion and stuffing may be accomplished by crimping under the influence of heated fluid so that the yarn is both expanded and crimped as it passes to the stuffing zone, and is then set in its deformation as it progresses in the stuffing.

These prior systems have been effective in stuffing yarns at speeds up to about 2500 meters/minute. However, at high linear speeds, such units with vents close to the nozzle have been prone to difficulties and have not been entirely satisfactory.

In the absence of braking or retarding of the stuffing, it can discharge too freely from the chamber.

Certain prior attempts at braking the exit of the stuffing have included flaps exerting a resistance and releasing the stuffing in accordance with the amount of material in the stuffed zone, such as disclosed in U.S. Pat. No. 2,575,781. Another form of brake is that of a sudden constriction or choking of the stuffing chamber, such as that disclosed in German Democratic Republic Pat. No. 17,786. In this latter case, the stuffed material necessarily is removed by external extraction means.

Also, U.S. Pat. No. 3,099,594 discloses a unit for loosening and temporarily stuffing a crimped yarn of filaments to provide a uniform distribution and permeation of a fluid-borne additive for cigarette filters. The opened filaments are temporarily accumulated at the outlet, by the resistance of spring leaves bearing against the yarn surface, while the fluid exits through the opened yarn to ensure deposit of the additive, as well as to further agitate the yarn filaments. The treated yarn is then passed to a stuffer and on to a cigarette-making machine.

However, none of the prior units have proven to be entirely satisfactory for stuffing multifilament yarns at high speeds of 3000 meters/minute and more.

SUMMARY OF THE INVENTION

In general, the preferred form of stuffing system of the present invention comprises a pneumatic injector nozzle including a yarn inlet and a fluid inlet, the nozzle being arranged to inject yarn into an elongated stuffing chamber. The stuffing chamber includes lateral vents remote form the injector nozzle and a radially-expansible restriction immediately downstream of the lateral vents.

The system injects multifilament yarn into the stuffing chamber and expands the yarn, stuffs the yarn into a stuffing in the restriction, and discharges the stuffing stepwise as the pressure of the stuffing fluid is cycled by restriction of the vents by the stuffing.

OBJECTS OF THE INVENTION

It is an object of the present invention to provide a method and apparatus for stuffing multifilament yarns at linear speeds exceeding 3000 meters/minute.

It is another object of the present invention to provide a method and apparatus for stuffing multifilament yarns at very high speeds and withdrawing the yarn in a stuffed state at a low rate of speed.

It is another object of the present invention to provide a yarn-stuffing system for expanding and stuffing yarns at very high speeds and discharging the stuffed yarns stepwise in its stuffed state.

A further object of the present invention is the provision of a yarn-stuffing system for expanding and stuffing yarns at extreme linear speeds and discharging the stuffed yarn in its compacted state at intervals.

A further object of the present invention is the provision of a yarn-stuffing system which discharges the stuffed yarn in its compacted state with a peristaltic action.

A further object of the present invention is the provision of a yarn-stuffing system which discharges the stuffed yarn in its compacted state through a resilient outlet and vents the stuffing fluid immediately upstream of the resilient outlet.

A further object of the present invention is the provision of a yarn-stuffing system which discharges the stuffing by a form of peristalsis under the influence of the pressure of the stuffing fluid and a resilient and expandable constriction.

BRIEF DESCRIPTION OF THE DRAWINGS

These and other objects of the invention will be more readily understood from the following description and the description and the accompanying drawings in which.

DETAILED DESCRIPTION OF THE PREFERRED EMBODIMENT

Figure 1:
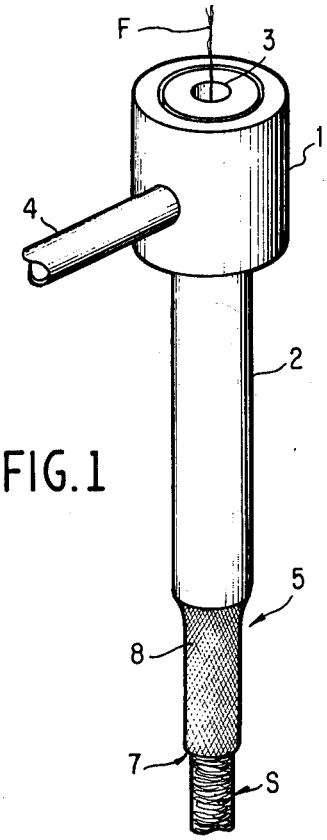
FIG. 1 is a perspective view of the preferred view of the preferred form of yarn-stuffing systems.
Figure 2:
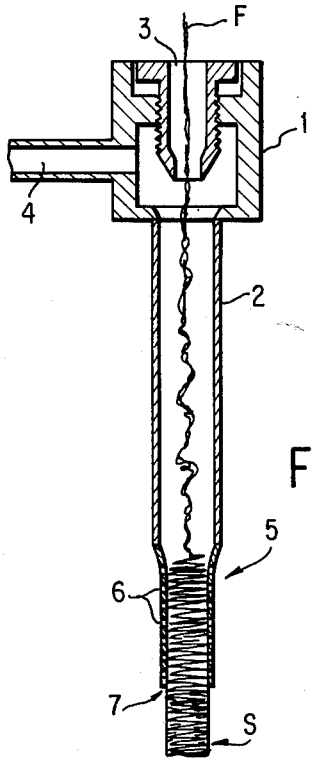
FIG. 2 is a partly-schematic sectional elevation of yarn-stuffing unit of FIG. 1.

As shown in FIGS. 1 and 2, the preferred form of yarn-stuffing system comprises a pneumatic injector 1 connected with an elongated cylindrical chamber 2. The nozzle 1 includes a yarn inlet 3 and a fluid inlet 4.

The elongated chamber 2 has a flexible, constricted portion 5 which includes a plurality of lateral vent apertures 6 upstream of the discharge outlet 7.

The constricted portion 5 may take several forms. As shown in FIG. 1, the constricted portion is formed of a biascut screen material 8 capable of radial expansion and contraction.

Figure 3:
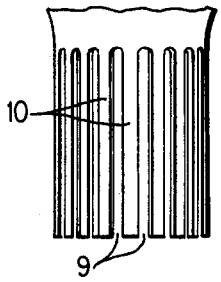
FIG. 3 is a side view, on an enlarged scale, of a form of venting restrictor.
Figure 4:
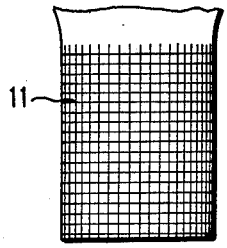
FIG. 4 is a view similar to FIG. 3 and showing a modified form of venting restrictor.

The constricted portion shown in FIG. 3 is formed by a plurality of longitudinal vent slots 9 which are separated by lands 10. The constricted portion of FIG. 4 is formed of a flexible screening material 11.

The requisites of a suitable constricted portion 5 of the present invention are those of flexibility in the radial direction and the presence of peripheral venting apertures distributed longitudinally therealong, in addition to a slightly smaller internal diameter than that of the elongated chamber 5. The constricted portions may be formed as an integral part of the elongated chamber 5, or may be provided as a detachable accessory, as desired.

OPERATION OF THE PREFERRED SYSTEM

In operation, a suitable fluid is introduced via the inlet 4 and draws the filament F through the inlet 3 at extreme speeds, thereby loosening and separating the multiple filaments of the yarn. The yarn and fluid then continue at high speed through the longitudinal chamber until they reach the constricted portion 5.

The release of yarn laterally via the vents 6 suddenly decelerates the yarn in the constricted zone, which then compacts randomly in the smaller diameter portion 5 and forms a stuffing 9.

Continued introduction of fluid and yarn via the nozzle causes a growth or accumulation of the stuffing 9 within the constricted portion 5, progressively blocking an increasing area of the vents 6 and, consequently, increasing the pressure in the system.

When the pressure in the system builds sufficiently, the pressure on the plug of stuffing becomes sufficient to force radial flexure of the constricted portion 5, thereby allowing momentary slippage of the stuffing 9. The slippage of the stuffing thus reopens a portion of the area of vents 6, reducing the pressure in the system to a level below that required to flex the constricted portion.

Continued growth of the plug of stuffing in the constricted portion then again progressively obstructs sufficient area of the vents to cause another slippage of the stuffing along the portion 5 and out of the discharge 7.

The stuffing 9 thus periodically emerges stepwise in a peristaltic manner to form an elongated package of stuffed yarn, with the constricted portion acting as a limited sphincter.

EXAMPLE 1

An ethylene glycol polyterephthalate yarn extruded at a rate of 750 meters/minute is then continuously drawn at 3,000 meters/minute. At the exit of the drawing device, the yarn is passed into a stuffing unit as shown in FIG. 1, but with a constricted portion of the type shown in FIG. 3. The yarn, of 460 dtex/60 strands, is fed at 3,000 meters/minute into the injector where it comes in contact with compressed air at a pressure of 5 kg/cm$^2$, and at ambient temperature. The yarn is thus opened, the filaments separate, and the velocity of the system drives the yarn into the constricted portion, which has a diameter of 12 mm. The yarn is there stuffed and comes out in a peristaltic manner at a rate of 2.5 meters/minute.

EXAMPLE 2

A polyhexamethylene adipamide yarn extruded at a rate of 400 meters/minute, is then continuously drawn at 3,000 meters/minute. At the exit of the drawing device, the yarn, with a count of 2300 dtex/136 strands then is delivered to the stuffing unit of Example 1 and encounters air compressed at a pressure of 6 kg/cm$^2$ and ambient temperature. The stuffing thus produced emerges in a peristaltic manner at a rate of 10 meters/-minute.

Figure 5:
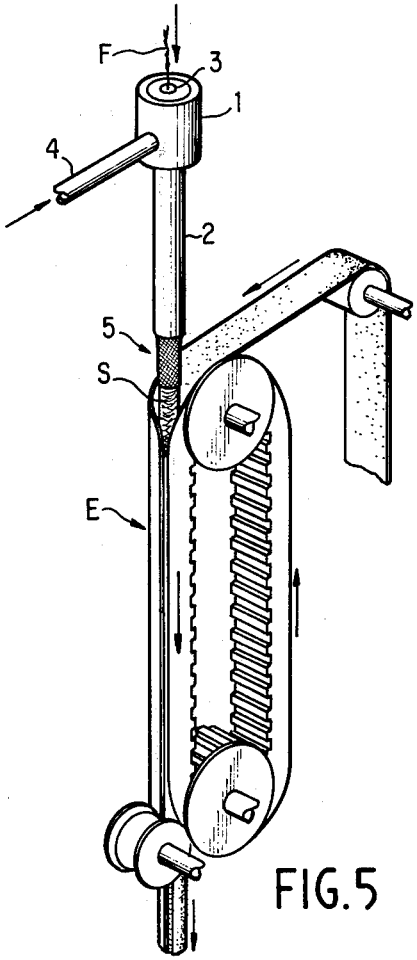
FIG. 5 is a perspective view of a stuffing and encasing installation according to the invention.

The emerging stuffing is quite suitable for pakaging for transfer to subsequent operations, thereby avoiding the need for immediate separation and winding for transport. An appropriate system is shown in FIG. 5, in which an envelope E is supplied to the stuffing as it emerges from the stuffing unit.

The stuffing system of the present invention is quite capable of operation in integrated systems which are the current trend in industry, as opposed to the prior separate-batch operations. With this trend toward integrated systems, the linear speeds at which yarn is handled and treated are exceeding 3,000 meters/minute, and it is anticipated that eventual speeds may reach 6,000 or 7,000 meters/minute or even more.

It is apparent, from the foregoing, that the present invention provides a particularly effective stuffing system which is mechanically simple and yet particularly effective at very high yarn speeds.

Various changes may be made in the details of the invention, as disclosed, without sacrificing the advantages thereof or departing from the scope of the appended claims.

What is claimed is:

1. The method of stuffing yarn comprising the steps of:

a. injecting yarn into an elongated zone by means of a compressed fluid driving and agitating the yarn, b. confining the yarn and the fluid for travel longitudinally in said elongated zone, c. compacting the yarn into an accumulating stuffing, d. venting the fluid laterally from the elongated zone immediately upstream of the stuffing as the stuffing accumulates, e. blocking venting of the fluid progressively as the stuffing accumulates, f. expelling the accumulated stuffing abruptly as fluid pressure builds behind the stuffing to release the accumulated stuffing from the elongated zone so that the stuffing emerges peristaltically from the elongated zone and venting of the fluid is increased, and g. repeating steps a) through g) continuously to form an elongated package of stuffed yarn.

2. The method of claim 1 wherein the releasing step includes the step of:

expanding the stuffing laterally under the action of the fluid pressure to release the stuffing longitudinally with respect to the elongated tube.

3. The method of claim 1 wherein the peristaltical emergence of the stuffing is accomplished by radially compressing and radially releasing the stuffing repeatedly.

4. A pneumatic yarn stuffer comprising a. a pneumatic injector nozzle having b. a yarn inlet and c. a fluid inlet and d. an outlet, e. an elongated chamber in closed communication with said nozzle outlet, said elongated chamber terminating in f. a constricted portion having an internal diameter less than the diameter of the elongated chamber, said constricted portion having g. an outlet for stuffed yarn aligned with the nozzle outlet and the elongated chamber, said constricted portion further having h. a plurality of lateral fluid vents upstream of the stuffed yarn outlet, and said constricted portion being flexible in the radial direction.

5. The yarn stuffer of claim 4 in which the lateral vents are longitudinal slits extended upstream from the stuffed-yarn outlet.

6. The yarn stuffer of claim 4 in which the constricted portion is formed of a resilient mesh.

7. The yarn stuffer of claim 6 in which the resilient mesh is arranged on the bias.

8. The yarn stuffer of claim 6 in which the resilient mesh is formed of flexible material.

* * * * *